US012121057B2

(12) United States Patent
Lomas et al.

(10) Patent No.: US 12,121,057 B2
(45) Date of Patent: Oct. 22, 2024

(54) SMOKING SUBSTITUTE CONSUMABLE, DEVICE AND KIT

(71) Applicant: Imperial Tobacco Limited, Bristol (GB)

(72) Inventors: Pete Lomas, Liverpool (GB); Oliver Talbot, Liverpool (GB)

(73) Assignee: Imperial Tobacco Limited Bristol, Bristol (GB)

( * ) Notice: Subject to any disclaimer, the term of this patent is extended or adjusted under 35 U.S.C. 154(b) by 425 days.

(21) Appl. No.: 17/677,428

(22) Filed: Feb. 22, 2022

(65) Prior Publication Data

US 2022/0175035 A1 Jun. 9, 2022

Related U.S. Application Data

(63) Continuation of application No. PCT/EP2020/073872, filed on Aug. 26, 2020.

(30) Foreign Application Priority Data

Aug. 30, 2019 (EP) ..... 19194641

(51) Int. Cl.
*A24F 40/42* (2020.01)
*A24F 40/10* (2020.01)

(52) U.S. Cl.
CPC ..... *A24F 40/42* (2020.01); *A24F 40/10* (2020.01)

(58) Field of Classification Search
CPC ..... A24F 40/42; A24F 40/10; A61M 15/06
See application file for complete search history.

(56) References Cited

U.S. PATENT DOCUMENTS

| | | | |
|---|---|---|---|
| 2014/0096781 | A1 | 4/2014 | Sears et al. |
| 2017/0224016 | A1 | 8/2017 | Reevell |
| 2017/0273355 | A1 | 9/2017 | Rogers et al. |
| 2019/0037882 | A1 | 2/2019 | Framroze et al. |

FOREIGN PATENT DOCUMENTS

| | | | | |
|---|---|---|---|---|
| DE | 2959784 | A1 * | 12/2015 | ..... A24F 47/00 |
| EP | 2 959 784 | A1 | 12/2015 | |
| GB | 2 542 006 | A | 3/2017 | |

OTHER PUBLICATIONS

European Patent Office acting as the International Search Authority, International Search Report and Written Opinion regarding PCT/EP2020/073872, Oct. 29, 2020, 14 pages.
European Search Report (19194641.7-1004), Apr. 20, 2020, 8 pages.

* cited by examiner

*Primary Examiner* — Christopher M Rodd
*Assistant Examiner* — Ronnie Kirby Jordan
(74) *Attorney, Agent, or Firm* — DUNLAP CODDING, P.C.

(57) ABSTRACT

Disclosed is a smoking substitute consumable insertable into a smoking substitute device in at least a first orientation and a second orientation. The consumable comprising: an electrical contact configured to interface with a corresponding electrical contact of the smoking substitute device, the electrical contact located at a contact end of the consumable; and at least one data contact region configured to interface with at least one corresponding data contact region of the smoking substitute device for data exchange when the smoking substitute consumable is inserted into the smoking substitute device in either the first orientation or the second orientation.

13 Claims, 12 Drawing Sheets

SMOKING SUBSTITUTE CONSUMABLE, DEVICE AND KIT

STATEMENT

This application is a non-provisional application claiming benefit to the international application no. PCT/EP2020/073872 filed on Aug. 26, 2020, which claims priority to EP 19194641.7 filed on Aug. 30, 2019. The entire contents of each of the above-referenced applications are hereby incorporated herein by reference in their entirety.

FIELD OF THE DISCLOSURE

The present disclosure relates to a smoking substitute device and more particularly, but not exclusively, to a smoking substitute consumable for use with a smoking substitute device.

BACKGROUND

The smoking of tobacco is generally considered to expose a smoker to potentially harmful substances. It is generally thought that a significant amount of the potentially harmful substances is generated through the heat caused by the burning and/or combustion of the tobacco and the constituents of the burnt tobacco in the tobacco smoke itself.

Combustion of organic material such as tobacco is known to produce tar and other potentially harmful by-products. There have been proposed various smoking substitute devices in order to avoid the smoking of tobacco.

Such smoking substitute devices can form part of nicotine replacement therapies aimed at people who wish to stop smoking and overcome a dependence on nicotine.

Smoking substitute devices, which may also be known as electronic nicotine delivery systems, may comprise electronic systems that permit a user to simulate the act of smoking by producing an aerosol, also referred to as a "vapor", which is drawn into the lungs through the mouth (inhaled) and then exhaled. The inhaled aerosol typically bears nicotine and/or flavorings without, or with fewer of, the odor and health risks associated with traditional smoking.

In general, smoking substitute devices are intended to provide a substitute for the rituals of smoking, whilst providing the user with a similar experience and satisfaction to those experienced with traditional smoking and tobacco products.

The popularity and use of smoking substitute devices has grown rapidly in the past few years. Although originally marketed as an aid to assist habitual smokers wishing to quit tobacco smoking, consumers are increasingly viewing smoking substitute devices as desirable lifestyle accessories. Some smoking substitute devices are designed to resemble a traditional cigarette and are cylindrical in form with a mouthpiece at one end. Other smoking substitute devices do not generally resemble a cigarette (for example, the smoking substitute device may have a generally box-like form).

There are a number of different categories of smoking substitute devices, each utilizing a different smoking substitute approach. A smoking substitute approach corresponds to the manner in which the substitute system operates for a user.

One approach for a smoking substitute device is the so-called "vaping" approach, in which a vaporizable liquid, typically referred to (and referred to herein) as "e-liquid", is heated by a heater to produce an aerosol vapor which is inhaled by a user. An e-liquid typically includes a base liquid as well as nicotine and/or flavorings. The resulting vapor therefore typically contains nicotine and/or flavorings. The base liquid may include propylene glycol and/or vegetable glycerin.

A typical vaping smoking substitute device includes a mouthpiece, a power source (typically a battery), a tank or liquid reservoir for containing e-liquid, as well as a heater. In use, electrical energy is supplied from the power source to the heater, which heats the e-liquid to produce an aerosol (or "vapor") which is inhaled by a user through the mouthpiece.

Vaping smoking substitute devices can be configured in a variety of ways. For example, there are "closed system" vaping smoking substitute devices which typically have a heater and a sealed tank which is pre-filled with e-liquid and is not intended to be refilled by an end user. One subset of closed system vaping smoking substitute devices include a main body which includes the power source, wherein the main body is configured to be physically and electrically coupled to a consumable including the tank and the heater. In this way, when the tank of a consumable has been emptied, the main body can be reused by connecting it to a new consumable. Another subset of closed system vaping smoking substitute devices are completely disposable, and intended for one-use only.

There are also "open system" vaping smoking substitute devices which typically have a tank that is configured to be refilled by a user, so the device can be used multiple times.

An example vaping smoking substitute device is the Myblu™ e-cigarette. The Myblu™ e cigarette is a closed system device which includes a main body and a consumable. The main body and consumable are physically and electrically coupled together by pushing the consumable into the main body. The main body includes a rechargeable battery. The consumable includes a mouthpiece, a sealed tank which contains e-liquid, as well as a vaporizer, which for this device is a heating filament coiled around a portion of a wick which is partially immersed in the e-liquid. The device is activated when a microprocessor on board the main body detects a user inhaling through the mouthpiece. When the device is activated, electrical energy is supplied from the power source to the vaporizer, which heats e-liquid from the tank to produce a vapor which is inhaled by a user through the mouthpiece.

Another example vaping smoking substitute device is the blu PRO™ e-cigarette. The blu PRO™ e cigarette is an open system device which includes a main body, a (refillable) tank, and a mouthpiece. The main body and tank are physically and electrically coupled together by screwing one to the other. The mouthpiece and refillable tank are physically coupled together by screwing one into the other, and detaching the mouthpiece from the refillable tank allows the tank to be refilled with e-liquid. The device is activated by a button on the main body. When the device is activated, electrical energy is supplied from the power source to a vaporizer, which heats e-liquid from the tank to produce a vapor which is inhaled by a user through the mouthpiece.

Smoking substitute consumables, often referred to "pods", "cartridges" or "cartomizers" often comprise a tank which contains a reservoir of e-liquid for the consumption of the user of the device. It is known in the art that these consumables may often require an electrical contact configured to interface with a corresponding electrical contact of the smoking substitute device. This typically allows the consumable to have an electrical power exchange with the device, and is often required in order to electrically power the heater and/or vaporizer within the consumable, for example.

In known prior art smoking substitute systems, the consumable typically has one or more protruding electrical contacts (e.g., plugs, prongs, pins, or pads), configured to engage with the corresponding electrical contact of the device (e.g., corresponding plug/pin sockets or pads). For example, there may be two electrical contacts that engage between the device and the consumable in order to complete a circuit so that current can flow, and power be transferred to the heating filament coil within the consumable for the purpose of heating the wick and vaporizing the e-liquid.

Protruding contacts often comprise delicate or thin metallic connectors which are prone to being bent or broken, particularly over time and with continual use. This is problematic, and can lead to a failure of the contacts belonging to the consumable, the corresponding device, or even both, which can be costly to replace and a nuisance for the user. Moreover, in known prior art smoking substitute systems the contacts are both typically located at one end of the consumable. As such, whenever the user wishes to connect the consumable to the device, the user is required to orientate the consumable in a particular way (e.g., by rotating the consumable about a longitudinal axis of the consumable) in order to ensure a correct alignment of the contacts of the consumable with corresponding contacts at the device end. This can be tediously laborious, time consuming, and a nuisance for the user.

Moreover, by requiring the user to always ensure that the orientation of the consumable is correct, there is an increased risk in the user either wrongly orientating, or misaligning, the contacts of the consumable with the corresponding contacts of the device. This increases the risks of both damage and the failure of such contacts, particularly if they are delicate or thin, and is therefore further problematic.

There is therefore a need for an improved design of a smoking substitute consumable and device, and the present disclosure has been devised in the light of the above considerations. It is against this background that the disclosures of the present application are formulated.

SUMMARY OF THE DISCLOSURE

Broadly speaking, the present disclosure addresses the problems set out above in the provision of a smoking substitute device or consumable in which a data contact region of the consumable is configured to interface with a corresponding data region of the smoking substitute device regardless of the orientation in which the consumable is inserted.

More specifically, according to a first aspect of the disclosure, there is a smoking substitute consumable insertable into a smoking substitute device in at least a first orientation and a second orientation. The consumable comprises: an electrical contact configured to interface with a corresponding electrical contact of the smoking substitute device, the electrical contact located at a contact end of the consumable, and at least one data contact region configured to interface with at least one corresponding data contact region of the smoking substitute device for data exchange when the smoking substitute consumable is inserted into the smoking substitute device in either the first orientation or the second orientation.

Advantageously, in addition to having an electrical contact, the consumable includes a data contact for data exchange, or electric communication, between the consumable and the device.

In especially preferred embodiments, the contact end of the consumable includes a recess defining an inner circumferential surface and the at least one data contact region is either formed by, or located on the inner circumferential surface.

Data contacts may enable the consumable to electrically communicate information with the device, and by extension, communicate information with the user of that device. Such information may include a characteristic of the e-liquid (e.g., a type of e-liquid). The characteristic may include a flavor, a nicotine content/strength of the e-liquid contained within the reservoir of that particular consumable, for example. Different consumables owned by the user may contain different e-liquid types, however the consumables may appear identical to each other on the exterior, particularly if the e-liquid is not clearly visible to the user. The disclosure advantageously enables a "smart" (or "smart pod") functionality of the device, where the user is able to quickly determine the e-liquid type upon connection of the consumable with the device, without having to inhale or taste the e-liquid to make such a determination, for example. This may be particularly beneficial to the user, as it is often not possible to distinguish between different consumables by merely observing their outer appearances, for example. Furthermore this "smart" functionality provides the user with a more premium product feel.

The contact end of the consumable may be the part of the consumable that connects with the device, and is typically located at one end of a main body of the consumable. However, the data contact region may be (fully or partially) located along a circumference of the consumable. This advantageously allows the consumable to be inserted in any direction that allows for the electrical contacts to be engaged with corresponding electrical contacts of the device. As such, whenever the user wishes to connect the consumable to the device, the user is not always required to orientate the consumable in a particular way (e.g., by rotating the consumable about a longitudinal axis of the consumable) in order to ensure a correct alignment of the contacts of the consumable with corresponding contacts at the device end. As such, the user's experience of the device is improved as it may be less fiddly to use, and less time consuming to operate. Furthermore, the ability of the disclosure to freely orientate the consumable in order to connect it with the device provides the user with a more premium product feel (e.g., a "click-and-go" freedom).

Moreover, as the device is able to accept multiple orientations of the consumable, there may be a reduced need for user to always ensure that the orientation of the consumable is correct. As such, there may be further advantages in that there is reduced risk of the user either wrongly orientating, or misaligning, the contacts of the consumable with the corresponding contacts of the device. This may subsequently reduce the risk of both damage and failure of the corresponding contacts caused by user mistaking forcing incorrectly aligned, or misaligning, contacts together, for example.

In some embodiments, the consumable may be insertable into the smoking substitute device in an insertion direction, wherein the cross-section of the consumable, when viewed in a direction perpendicular to the insertion direction has two or more degrees of rotational symmetry, and the consumable includes a plurality of data contact regions, including at least one data contact region per degree of rotational symmetry. For example, if the cross-section were to have three-way rotational symmetry, the consumable would include at least three data contact regions. In this way, the consumable could be inserted into the device in at least three orientations. Here, the term "rotational symmetry" refers to the gross structure of the cross-section, and is intended to cover embodiments in which there are variations which do not affect the ability of the consumable to be inserted into the smoking substitute device in the corresponding number of orientations.

The term "data contact region" here covers cases in which the plurality of data contact regions are either separate, or are individual sub-regions of a single data contact. More specifically, in some cases, the plurality of data contact regions may include a first data contact and a second data contact which are circumferentially spaced from each other. In embodiments with more than two degrees of rotation symmetry, all of the data contact regions may be individual data contacts which are all circumferentially spaced from each other. The term "circumferentially" here is not restricted to a circular perimeter, but refers to any spacing around the perimeter of the consumable. For example, the consumable may have a square cross-section with four separate data contacts, spaced around the perimeter of the square—this would still be covered by "circumferentially spaced". In a preferred case, the cross-section has an even number of degrees of rotational symmetry, or is circular. In such cases, the first data contact may be on a first side of the consumable, and the second data contact may be on a second side of the consumable, the first side and the second side being opposite each other.

As mentioned above, in other cases, the at least one data contact region or plurality of data contact regions may all form part of a single data contact. In other words, there may be one data contact, sub-regions of which form the at least one data contact region or plurality of data contact regions. It is therefore important to note the distinction in this application between the terms "data contact" and "data contact region".

In one such embodiment, the single data contact includes a circumferential data contact. In other words, rather than it being a protruding contact (e.g., a plug, prong, pin, pad etc.), it may be located partially or all the way around the circumference of the consumable. Circumferential data contacts may intrinsically be more robust than protruding contacts as they are typically less prone to being bent or broken when compared with protruding metal contacts. As such, by using a circumferential data contact (e.g., in place of a protruding contact), the instances of the data contacts of the device and/or the consumable breaking are reduced.

The electrical contact may comprise at least one plug, prong, pin, and/or pad contact configured to engage the corresponding electrical contact of the device.

The at least one circumferential data contact may comprise a full annular region or a full cylindrical contact region.

The at least one data contact region may be located on an outer circumferential surface of the consumable, in cases including a single e.g., circumferential data contact, or a plurality of individual data contacts.

A full cylindrical contact region may be a data contact region in the shape of a cylinder with one end "closed off" by at least one full circular plate of material. In such embodiments, the outer surface area of the full cylindrical contact region may be defined by the combined outer surface areas of a central cylindrical shell (or trunk) and the at least one circular plate of material either located at the top or bottom of the central cylindrical shell. The circle may have a diameter, radius, or circumference equal to that of the cylindrical shell. Alternatively, the full cylindrical contact region may be in the form of a full cylindrical shell which does not have a circular plate at either end.

A full annular contact region may be a data contact region in the shape of either a torus (also known as a "doughnut" shape) or a ring (also known as an annulus). As such, the surface area of the full annular contact may be defined by the outer surface area of either a torus or a ring. The torus or ring may have an outer circumference and an inner circumference, wherein the outer circumference is greater than the inner circumference.

Alternatively, the at least one data contact region may comprise a partial annular region or a partial cylindrical contact region.

A partial annular region may be a data contact region in the shape of an incomplete (or partial) torus, whereby the torus may not be fully formed along either its poloidal or toroidal axis. A partial annular region may be a data contact region in the shape of an incomplete (or partial) ring, whereby the ring may not be fully formed along either its radial or its circumferential axis.

A partial cylindrical contact region may be a data contact region in the shape of an incomplete cylinder. Alternatively, the partial cylindrical contact region may be a data contact region in the shape of the cylindrical shell (or trunk) only. In this way, the outer surface area of a partial cylinder may be defined by the incomplete outer surface area of the cylindrical shell. Here, an "incomplete outer surface area" should be understood to mean that the cylindrical shell does not extend a full 360° around the circumference or perimeter of the consumable.

The annular or cylindrical contact region may have a circular or elliptical shape. In this way the annular or cylindrical contact region may define a contact region (or contact surface) which has a two-dimensional profile, such as a circle. Alternatively, the contact region may have any two-dimensional profile which is rotationally symmetrical about the longitudinal axis of the consumable, such as a square shape, a pentagon shape, or a hexagon shape, as discussed earlier.

The at least one data contact region may be located at a region of the outer circumferential surface of the consumable which is longitudinally (i.e., along the length of the consumable) spaced from the contact end. In other words, the contact region may be at a location on the consumable that may be separated, or spaced away from, the contact end of the consumable. This spacing may be a formed by a separator. In an example embodiment, the separator may be formed from an electrically insulating material.

As mentioned above, the contact end of the consumable may include a recess (or cavity) defining an inner circumferential surface. Accordingly, the cylindrical shell may have an internal surface area which defines an inner circumferential surface. The inner circumferential surface may be defined by the internal surface area of the central cylindrical shell (or trunk). Alternatively, the inner circumferential surface may be defined by the internal surface area of the central cylindrical shell (or trunk) in combination with the internal surface of at least one circular end of the cylinder.

The at least one data contact region may be either formed by, or located anywhere on, the inner circumferential surface.

In this way, the at least one data contact region may be formed by all, or part of, the inner circumferential surface area formed by the internal surface area of the central cylindrical shell (or trunk), or the internal surface area of the central cylindrical shell in combination with the internal surface of at least one circular end of the cylinder.

The at least one data contact region may be located anywhere on the internal surface area of the central cylindrical shell. For example, the data contact may be connection area, or connection point, located anywhere on the larger area of the internal surface area of the central cylindrical shell, or the internal surface area of the central cylindrical shell in combination with the internal surface of at least one circular end of the cylinder.

The at least one data contact region may be formed by, or located anywhere on, an end surface of the consumable. The end surface of the consumable may be a full or partial surface area of the contact end of the consumable. This end surface may comprise a full circle, or a ring/annulus.

The consumable may have more than one of the circumferential data contacts according to the previous statements.

One or more data contact regions according to any one of the previous statements may be located anywhere on the consumable, for example along the circumference of the tank housing.

Alternatively, or additionally, one or more data contact regions may be located on the contact end itself. For example, if there are multiple data contact regions located on the contact end, they may be concentrically orientated.

According to a second aspect of the disclosure, there may be a smoking substitute device for use with a smoking substitute consumable according to any one of the previous statements.

The device may comprise a recess configured to receive the contact end of the consumable.

The recess may be cylindrical and comprise an inner circumference and a floor.

The corresponding data contact region of the device may be formed by, or located anywhere on, the inner circumference of the recess.

The inner circumference may be circular or elliptical in shape.

The corresponding electrical contact of the device may be located anywhere on the floor of the recess and comprises at least one socket and/or pad contact.

The device may have more than one corresponding data contacts formed by, or located anywhere on, the inner circumference of the recess.

The one or more corresponding data contacts of the device may be any one of the data contact regions described in the previous statements.

The one or more corresponding data contacts of the device may be located on the inner circumference and/or floor. For example, if there are multiple data contact regions located on the floor, they may be concentrically orientated.

Alternatively, or additionally, if there are multiple data contact regions located on the inner circumference, they may be separated, or spaced away from each other along the longitudinal axis of the device.

According to a third aspect of the disclosure, there may be a smoking substitute kit comprising the smoking substitute consumable according to any one of the previous statements and the smoking substitute device according to any one of the previous statements.

Further optional features of the disclosure will be set out below, particularly those features relating to the smoking substitute device or consumable themselves.

The smoking substitute device may comprise a passage for fluid flow therethrough. The passage may extend through (at least a portion of) the smoking substitute device, between openings that may define an inlet and an outlet of the passage. The outlet may be at a mouthpiece of the smoking substitute device. In this respect, a user may draw fluid (e.g., air) into and through the passage by inhaling at the outlet (i.e., using the mouthpiece).

The device may comprise a tank (reservoir) for containing a vaporizable liquid (e.g., an e-liquid). The e-liquid may, for example, comprise a base liquid and e.g., nicotine. The base liquid may include propylene glycol and/or vegetable glycerin.

The tank may be defined by a tank housing. At least a portion of the tank housing may be translucent. For example, the tank housing may comprise a window to allow a user to visually assess the quantity of e-liquid in the tank. The tank may be referred to as a "clearomizer" if it includes a window, or a "cartomizer" if it does not. The passage may extend longitudinally within the tank and a passage wall may define the inner wall of the tank. In this respect, the tank may surround the passage e.g., the tank may be annular. The passage wall may comprise longitudinal ribs extending there-along. These ribs may provide support to the passage wall. The ribs may extend for the full length of the passage wall. The ribs may project (e.g., radially outwardly) into the tank.

The smoking substitute device may comprise a vaporizer. The vaporizer may comprise a wick. The vaporizer may further comprise a heater. The wick may comprise a porous material. A portion of the wick may be exposed to fluid flow in the passage. The wick may also comprise one or more portions in contact with liquid stored in the reservoir. For example, opposing ends of the wick may protrude into the reservoir and a central portion (between the ends) may extend across the passage so as to be exposed to fluid flow in the passage. Thus, fluid may be drawn (e.g., by capillary action) along the wick, from the reservoir to the exposed portion of the wick.

The heater may comprise a heating element, which may be in the form of a filament wound about the wick (e.g., the filament may extend helically about the wick). The filament may be wound about the exposed portion of the wick. The heating element may be electrically connected (or connectable) to a power source. Thus, in operation, the power source may supply electricity to (i.e., apply a voltage across) the heating element so as to heat the heating element. This may cause liquid stored in the wick (i.e., drawn from the tank) to be heated so as to form a vapor and become entrained in fluid flowing through the passage. This vapor may subsequently cool to form an aerosol in the passage.

The device may be in the form of a consumable. The consumable may be configured for engagement with a main body (i.e., so as to form a smoking substitute system). For example, the consumable may comprise components of the system that are disposable, and the main body may comprise non-disposable or non-consumable components (e.g., power supply, controller, sensor, etc.) that facilitate the delivery of aerosol by the consumable. In such an embodiment, the aerosol former (e.g., e-liquid) may be replenished by replacing a used consumable with an unused consumable.

In light of this, it should be appreciated that some of the features described herein as being part of the smoking substitute device may alternatively form part of a main body for engagement with the consumable.

The main body and the consumable may be configured to be physically coupled together. For example, the consumable may be at least partially received in a recess of the main body, such that there is snap engagement between the main body and the consumable. Alternatively, the main body and the consumable may be physically coupled together by screwing one onto the other, or through a bayonet fitting.

Thus, the consumable may comprise one or more engagement portions for engaging with a main body. In this way, one end of the consumable (i.e., the inlet end) may be coupled with the main body, whilst an opposing end (i.e., the outlet end) of the consumable may define a mouthpiece.

The main body or the consumable may comprise a power source or be connectable to a power source. The power source may be electrically connected (or connectable) to the heater. The power source may be a battery (e.g., a rechargeable battery). An external electrical connector in the form of e.g., a USB port may be provided for recharging this battery.

The consumable may comprise an electrical interface for interfacing with a corresponding electrical interface of the main body. One or both of the electrical interfaces may include one or more electrical contacts. Thus, when the main body is engaged with the consumable, the electrical interface may be configured to transfer electrical power from the power source to a heater of the consumable. The electrical interface may also be used to identify the consumable from a list of known types. The electrical interface may additionally or alternatively be used to identify when the consumable is connected to the main body.

The main body may alternatively or additionally be able to detect the information about the consumable via an RFID reader, a barcode or QR code reader. This interface may be able to identify a characteristic (e.g., a type) of the consumable. In this respect, the consumable may include any one or more of an RFID chip, a barcode or QR code, or memory within which is an identifier and which can be interrogated via the interface.

The consumable or main body may comprise a controller, which may include a microprocessor. The controller may be configured to control the supply of power from the power source to the heater (e.g., via the electrical contacts). A memory may be provided and may be operatively connected to the controller. The memory may include non-volatile memory. The memory may include instructions which, when implemented, cause the controller to perform certain tasks or steps of a method.

The consumable or main body may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WIFI®, are also possible. The wireless interface may also be configured to communicate wirelessly with a remote server.

An airflow (i.e., puff) sensor may be provided that is configured to detect a puff (i.e., inhalation from a user). The airflow sensor may be operatively connected to the controller so as to be able to provide a signal to the controller that is indicative of a puff state (i.e., puffing or not puffing). The airflow sensor may, for example, be in the form of a pressure sensor or an acoustic sensor. The controller may control power supply to the heater in response to airflow detection by the sensor. The control may be in the form of activation of the heater in response to a detected airflow. The airflow sensor may form part of the consumable or the main body.

In an alternative embodiment the device may be a non-consumable device in which an aerosol former (e.g., e-liquid) of the device may be replenished by re-filling the tank of the device (rather than replacing the consumable). In this embodiment, the consumable described above may instead be a non-consumable component that is integral with the main body. Thus, the device may comprise the features of the main body described above. In this embodiment, the only consumable portion may be e-liquid contained in the tank of the device. Access to the tank (for re-filling of the e-liquid) may be provided via e.g., an opening to the tank that is sealable with a closure (e.g., a cap).

The device may be a smoking substitute device (e.g., an e-cigarette device) and, when in the form of a consumable, may be a smoking substitute consumable (e.g., an e-cigarette consumable).

In a fourth aspect there is provided a smoking substitute system comprising a main body having a power source, and a consumable as described above with respect to the third aspect, the consumable being engageable with the main body such that a vaporizer of the consumable is connected to the power source of the main body.

The consumable may be an e-cigarette consumable. The main body may be as described above with respect to the second aspect. The main body may, for example, be an e-cigarette device for supplying power to the consumable.

In a fifth aspect there is provided a method of using a smoking substitute system as described above with respect to the third and fourth aspects, the method comprising engaging the consumable with the main body so as to connect the vaporizer of the consumable with the power source of the main body.

The disclosure includes the combination of the aspects and preferred features described except where such a combination is clearly impermissible or expressly avoided.

SUMMARY OF THE FIGURES

So that the disclosure may be understood, and so that further aspects and features thereof may be appreciated, embodiments illustrating the principles of the disclosure will now be discussed in further detail with reference to the accompanying figures, in which.

DETAILED DESCRIPTION

Aspects and embodiments of the present disclosure will now be discussed with reference to the accompanying figures. Further aspects and embodiments will be apparent to those skilled in the art. All documents mentioned in this text are incorporated herein by reference.

Figure 1A:
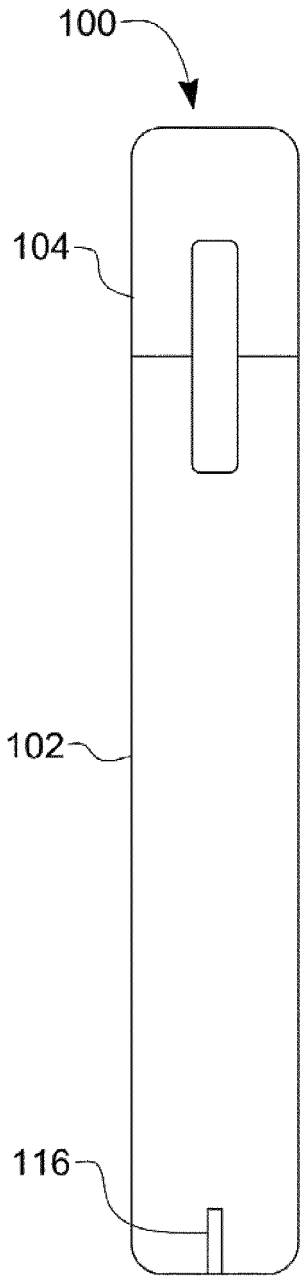
FIG. 1A is a front schematic view of a smoking substitute system.

FIG. 1A shows a first embodiment of a smoking substitute system 100. In this example, the smoking substitute system 100 includes a main body 102 and an aerosol delivery device in the form of a consumable 104. The consumable 104 may alternatively be referred to as a "pod", "cartridge" or "cartomizer". It should be appreciated that in other examples (i.e., open systems), the main body may be integral with the consumable such that the aerosol delivery device incorporates the main body. In such systems, a tank of the aerosol delivery device may be accessible for refilling the device.

Figure 1B:
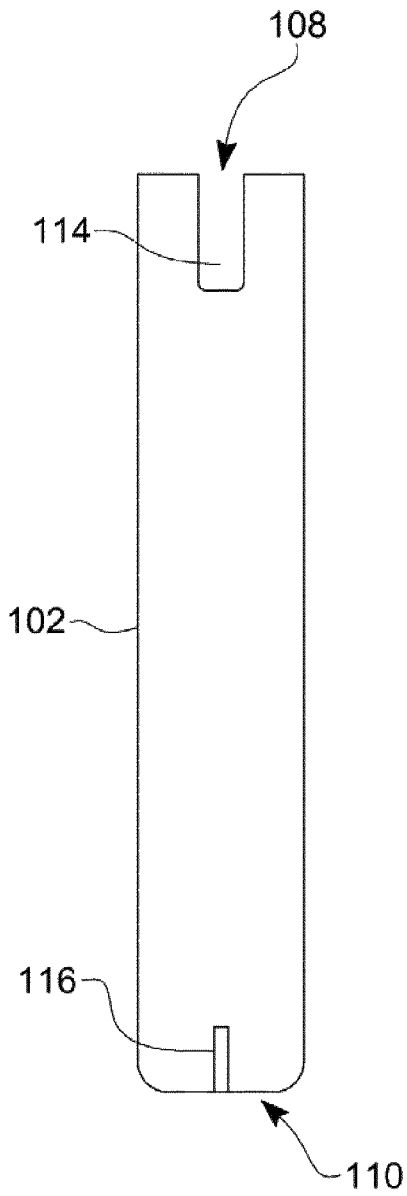
FIG. 1B is a front schematic view of a main body of the system.
Figure 1C:
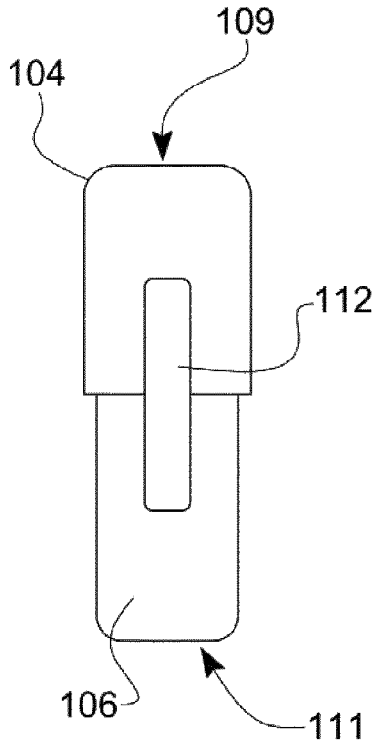
FIG. 1C is a front schematic view of a consumable of the system.

In this example, the smoking substitute system 100 is a closed system vaping system, wherein the consumable 104 includes a sealed tank 106 and is intended for single-use only. The consumable 104 is removably engageable with the main body 102 (i.e., for removal and replacement). FIG. 1A shows the smoking substitute device 100 with the main body 102 physically coupled to the consumable 104, FIG. 1B shows the main body 102 of the smoking substitute system 100 without the consumable 104, and FIG. 1C shows the consumable 104 of the smoking substitute system 100 without the main body 102.

The main body 102 and the consumable 104 are configured to be physically coupled together by pushing the consumable 104 into a recess located at an upper end 108 of the main body 102, such that there is an interference fit between the main body 102 and the consumable 104. In other examples, the main body 102 and the consumable may be coupled by screwing one onto the other, or through a bayonet fitting.

The consumable 104 includes a mouthpiece (not shown in FIG. 1A, 1B or 1C) at an upper end 109 of the consumable 104, and one or more air inlets (not shown) in fluid communication with the mouthpiece such that air can be drawn into and through the consumable 104 when a user inhales through the mouthpiece. The tank 106 containing e-liquid is located at the lower end, hereafter referred to as the 'contact end' 111, of the consumable 104.

The tank 106 includes a window 112, which allows the amount of e-liquid in the tank 106 to be visually assessed. The main body 102 includes a slot 114 so that the window 112 of the consumable 104 can be seen whilst the rest of the tank 106 is obscured from view when the consumable 104 is inserted into the recess at the upper end 108 of the main body 102.

The lower end 110 of the main body 102 also includes a light 116 (e.g., an LED) located behind a small translucent cover. The light 116 may be configured to illuminate when the smoking substitute system 100 is activated. Whilst not shown, the consumable 104 may identify itself to the main body 102, via an electrical interface, RFID chip, or barcode.

Figure 2A:
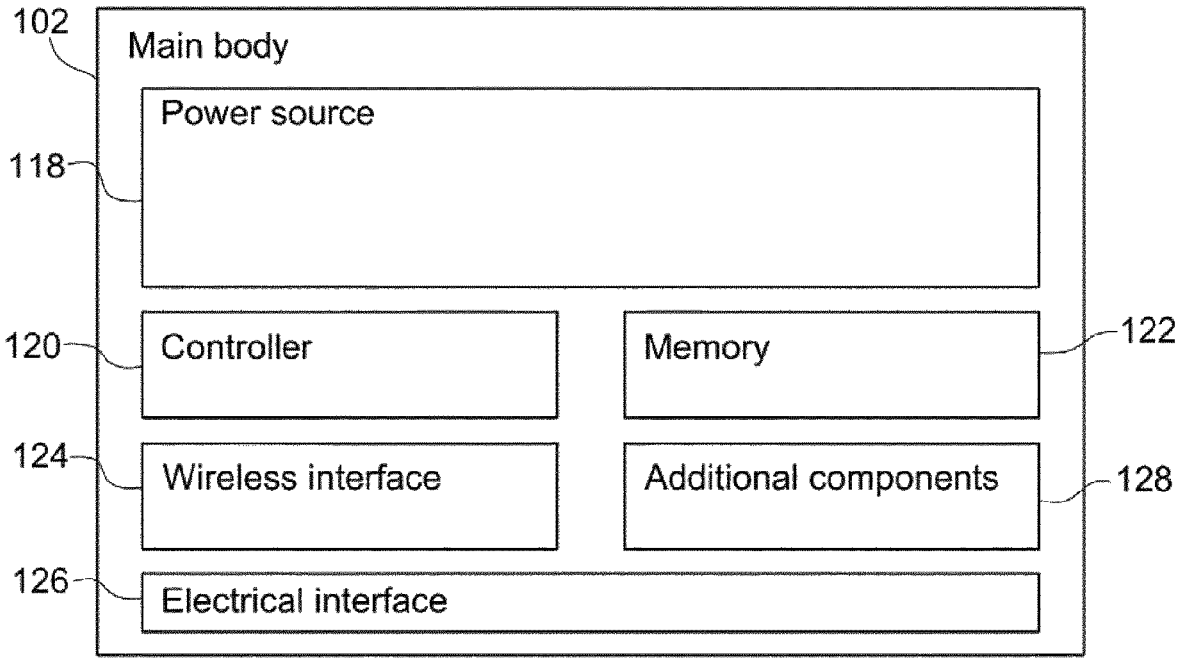
FIG. 2A is a schematic of the components of the main body.
Figure 2B:
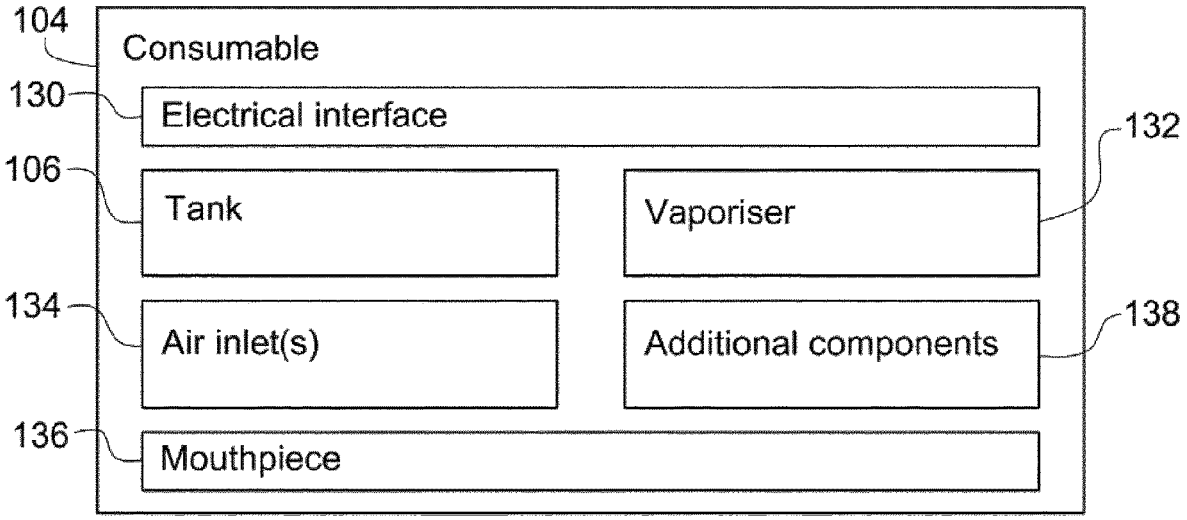
FIG. 2B is a schematic of the components of the consumable.

FIGS. 2A and 2B are schematic drawings of the main body 102 and consumable 104. As is apparent from FIG. 2A, the main body 102 includes a power source 118, a controller 120, a memory 122, a wireless interface 124, an electrical interface 126, and, optionally, one or more additional components 128.

The power source 118 is preferably a battery, more preferably a rechargeable battery. The controller 120 may include a microprocessor, for example. The memory 122 preferably includes non-volatile memory. The memory may include instructions which, when implemented, cause the controller 120 to perform certain tasks or steps of a method.

The wireless interface 124 is preferably configured to communicate wirelessly with another device, for example a mobile device, e.g., via Bluetooth®. To this end, the wireless interface 124 could include a Bluetooth® antenna. Other wireless communication interfaces, e.g., WIFI®, are also possible. The wireless interface 124 may also be configured to communicate wirelessly with a remote server.

The electrical interface 126 of the main body 102 may include one or more electrical contacts. The electrical interface 126 may be located in a base of the aperture in the upper end 108 of the main body 102. When the main body 102 is physically coupled to the consumable 104, the electrical interface 126 is configured to transfer electrical power from the power source 118 to the consumable 104 (i.e., upon activation of the smoking substitute system 100).

The electrical interface 126 may be configured to receive power from a charging station when the main body 102 is not physically coupled to the consumable 104 and is instead coupled to the charging station. The electrical interface 126 may also be used to identify the consumable 104 from a list of known consumables. For example, the consumable 104 may be a particular flavor and/or have a certain concentration of nicotine (which may be identified by the electrical interface 126). This can be indicated to the controller 120 of the main body 102 when the consumable 104 is connected to the main body 102. Additionally, or alternatively, there may be a separate communication interface provided in the main body 102 and a corresponding communication interface in the consumable 104 such that, when connected, the consumable 104 can identify itself to the main body 102.

The additional components 128 of the main body 102 may comprise the light 116 discussed above.

The additional components 128 of the main body 102 may also comprise a charging port (e.g., USB or micro-USB port) configured to receive power from the charging station (i.e., when the power source 118 is a rechargeable battery). This may be located at the lower end 110 of the main body 102. Alternatively, the electrical interface 126 discussed above may be configured to act as a charging port configured to receive power from the charging station such that a separate charging port is not required.

The additional components 128 of the main body 102 may, if the power source 118 is a rechargeable battery, include a battery charging control circuit, for controlling the charging of the rechargeable battery. However, a battery charging control circuit could equally be located in the charging station (if present).

The additional components 128 of the main body 102 may include a sensor, such as an airflow (i.e., puff) sensor for detecting airflow in the smoking substitute system 100, e.g., caused by a user inhaling through a mouthpiece 136 of the consumable 104. The smoking substitute system 100 may be configured to be activated when airflow is detected by the airflow sensor. This sensor could alternatively be included in the consumable 104. The airflow sensor can be used to determine, for example, how heavily a user draws on the mouthpiece or how many times a user draws on the mouthpiece in a particular time period.

The additional components 128 of the main body 102 may include a user input, e.g., a button. The smoking substitute system 100 may be configured to be activated when a user interacts with the user input (e.g., presses the button). This provides an alternative to the airflow sensor as a mechanism for activating the smoking substitute system 100.

As shown in FIG. 2B, the consumable 104 includes the tank 106, an electrical interface 130, a vaporizer 132, one or more air inlets 134, a mouthpiece 136, and one or more additional components 138.

The electrical interface 130 of the consumable 104 may include one or more electrical contacts (not shown in FIG. 2B). The electrical interface 126 of the main body 102 and an electrical interface 130 of the consumable 104 are configured to contact each other and thereby electrically couple the main body 102 to the consumable 104 when the contact end 111 of the consumable 104 is inserted into the upper end 108 of the main body 102 (as shown in FIG. 1A). In this way, electrical energy (e.g., in the form of an electrical current) is able to be supplied from the power source 118 in the main body 102 to the vaporizer 132 in the consumable 104.

The vaporizer 132 is configured to heat and vaporize e-liquid contained in the tank 106 using electrical energy supplied from the power source 118. As will be described further below, the vaporizer 132 includes a heating filament and a wick. The wick draws e-liquid from the tank 106 and the heating filament heats the e-liquid to vaporize the e-liquid.

The one or more air inlets 134 are preferably configured to allow air to be drawn into the smoking substitute system 100, when a user inhales through the mouthpiece 136. When the consumable 104 is physically coupled to the main body 102, the air inlets 134 receive air, which flows to the air inlets 134 along a gap between the main body 102 and the contact end 111 of the consumable 104.

In operation, a user activates the smoking substitute system 100, e.g., through interaction with a user input forming part of the main body 102 or by inhaling through the mouthpiece 136 as described above. Upon activation, the controller 120 may supply electrical energy from the power source 118 to the vaporizer 132 (via electrical interfaces 126, 130), which may cause the vaporizer 132 to heat e-liquid drawn from the tank 106 to produce a vapor which is inhaled by a user through the mouthpiece 136.

An example of one of the one or more additional components 138 of the consumable 104 is an interface for obtaining an identifier of the consumable 104. As discussed above, this interface may be, for example, an RFID reader, a barcode, a QR code reader, or an electronic interface which is able to identify the consumable. The consumable 104 may, therefore include any one or more of an RFID chip, a barcode or QR code, or memory within which is an identifier and which can be interrogated via the electronic interface in the main body 102.

It should be appreciated that the smoking substitute system 100 shown in FIGS. 1A to 2B is just one exemplary implementation of a smoking substitute system. For example, the system could otherwise be in the form of an entirely disposable (single-use) system or an open system in which the tank is refillable (rather than replaceable).

Figure 3:
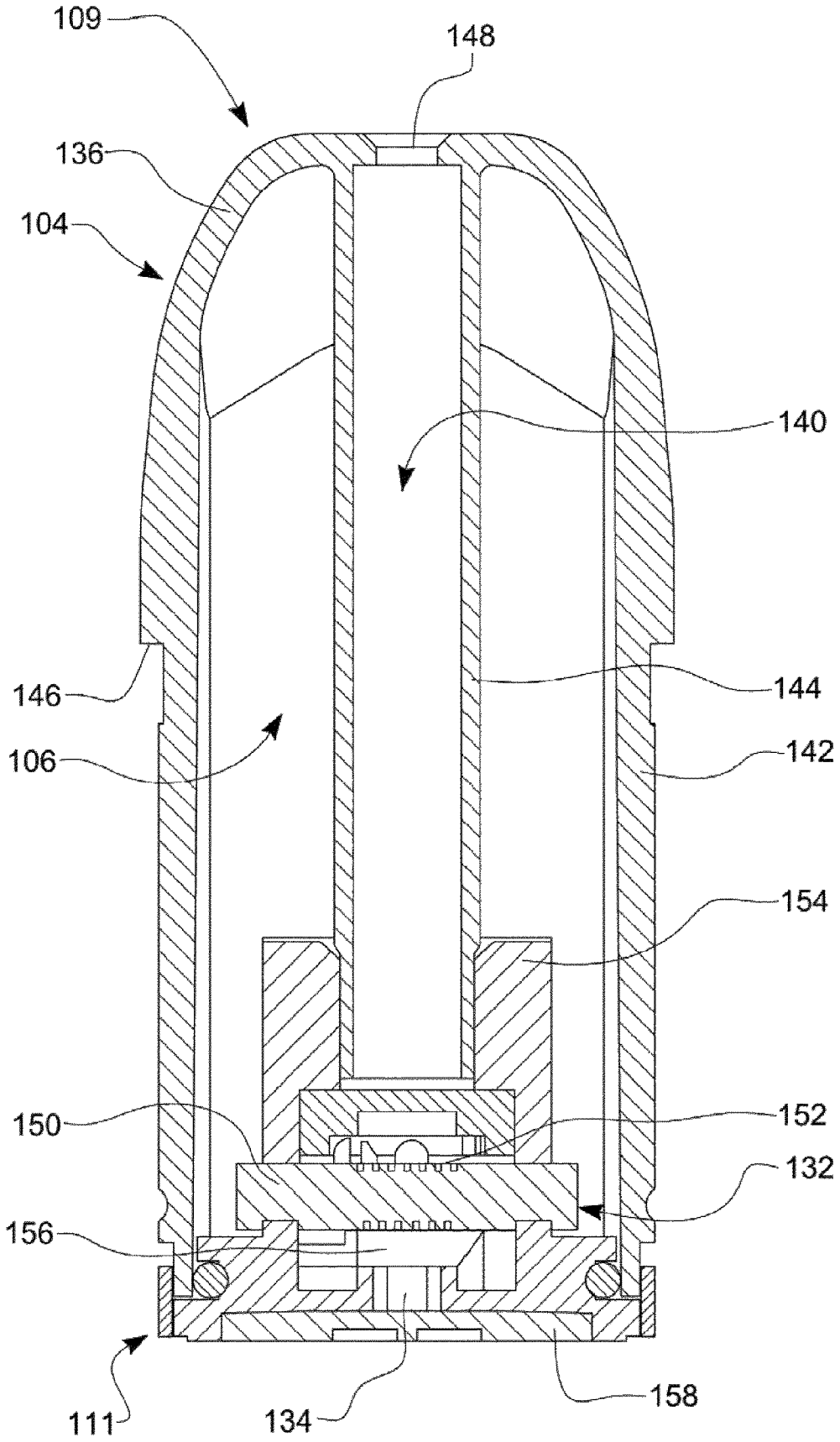
FIG. 3 is a section view of the consumable.

FIG. 3 is a section view of the consumable 104 described above. The consumable 104 comprises a tank 106 for storing e-liquid, a mouthpiece 136 and a passage 140 extending along a longitudinal axis of the consumable 104. In the illustrated embodiment the passage 140 is in the form of a tube having a substantially circular transverse cross-section (i.e., transverse to the longitudinal axis). The tank 106 surrounds the passage 140, such that the passage 140 extends centrally through the tank 106.

A tank housing 142 of the tank 106 defines an outer casing of the consumable 104, whilst a passage wall 144 defines the passage 140. The tank housing 142 extends from the contact end 111 of the consumable 104 to the mouthpiece 136 at the upper end 109 of the consumable 104. At the junction between the mouthpiece 136 and the tank housing 142, the mouthpiece 136 is wider than the tank housing 142, so as to define a lip 146 that overhangs the tank housing 142. This lip 146 acts as a stop feature when the consumable 104 is inserted into the main body 102 (i.e., by contact with an upper edge of the main body 102).

The tank 106, the passage 140 and the mouthpiece 136 are integrally formed with each other so as to form a single unitary component and may e.g., be formed by way of an injection molding process. Such a component may be formed of a thermoplastic material such as polypropylene.

The mouthpiece 136 comprises a mouthpiece aperture 148 defining an outlet of the passage 140. The vaporizer 132 is fluidly connected to the mouthpiece aperture 148 and is located in a vaporizing chamber 156 of the consumable 104. The vaporizing chamber 156 is downstream of the inlet 134 of the consumable 104 and is fluidly connected to the mouthpiece aperture 148 (i.e., outlet) by the passage 140.

The vaporizer 132 comprises a porous wick 150 and a heater filament 152 coiled around the porous wick 150. The wick 150 extends transversely across the chamber vaporizing 156 between sidewalls of the chamber 156 which form part of an inner sleeve 154 of an insert 158 that defines the contact end 111 of the consumable 104 that connects with the main body 102. The insert 158 is inserted into an open lower end of the tank 106 so as to seal against the tank housing 142.

In this way, the inner sleeve 154 projects into the tank 106 and seals with the passage 140 (around the passage wall 144) so as to separate the vaporizing chamber 156 from the e-liquid in the tank 106. Ends of the wick 150 project through apertures in the inner sleeve 154 and into the tank 106 so as to be in contact with the e-liquid in the tank 106. In this way, e-liquid is transported along the wick 150 (e.g., by capillary action) to a central portion of the wick 150 that is exposed to airflow through the vaporizing chamber 156. The transported e-liquid is heated by the heater filament 152 (when activated e.g., by detection of inhalation), which causes the e-liquid to be vaporized and to be entrained in air flowing past the wick 150. This vaporized liquid may cool to form an aerosol in the passage 140, which may then be inhaled by a user.

Figure 4:
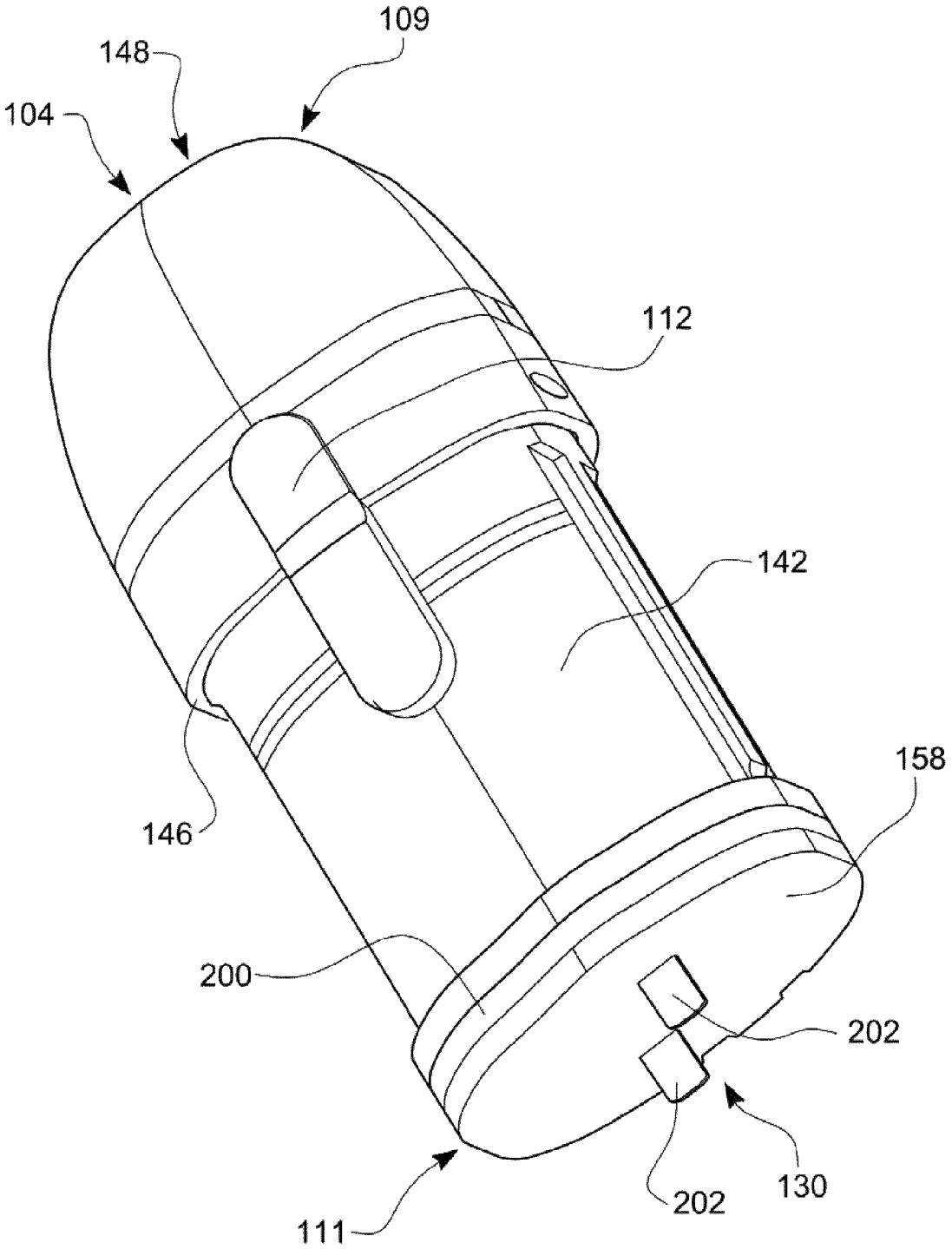
FIG. 4 is an isometric view of an embodiment of the present disclosure.

FIG. 4 shows an embodiment of the present disclosure, and is an isometric view of the consumable 104 similar to that shown FIG. 3, with the addition of at least one data contact 200.

Referring to FIG. 4, the consumable 104 comprises the electrical interface 130, as previously described. The electrical interface 130 comprises one or more electrical contacts 202. In the example embodiment shown in FIG. 4, there are two prong-type electrical contacts 202. As the skilled person will appreciate, the disclosure is not limited to the particular configuration shown, and the electrical interface 130 may comprise only one, or more than two, electrical contacts 202, for example. Moreover, the electrical contacts 202 may be of a different type to that shown in FIG. 4. For example, the electrical contacts 202 may comprises at least one plug, pin, and/or pad contact configured to engage the corresponding electrical contact of the device 100.

The electrical contacts 202 are configured to interface with a corresponding electrical contact (not shown in FIG. 4) belonging to the electrical interface 126 of the main body 102 of the device 100. The electrical contacts 202 are located at a contact end 111 of the consumable 104.

The at least one data contact 200 is configured to interface with at least one corresponding data contact (not shown in FIG. 4) of the device 100. This allows for the consumable 104 to communicate and/or exchange information (e.g., data) with the device 100, and vice versa.

In one embodiment the consumable 104 is insertable into the device 100 in at least a first orientation and a second orientation. The consumable 104 comprising: an electrical contact 202 configured to interface with a corresponding electrical contact of the device 100. The electrical contact 202 is located at the contact end 111 of the consumable 104, and at least one data contact 200 is configured to interface with at least one corresponding data contact of the device 100 for data exchange when the consumable 104 is inserted into the device 100 in either the first orientation or the second orientation.

In another embodiment, the at least one data contact 200 includes, or is, a circumferential data contact.

In a preferred embodiment, the consumable 104 may comprise a data circuit (not shown in any of the figures) which provides a circuit connection between the consumable 104 and the device 100 once the consumable 104 is connected to the main body 102 of the device 100, as previously described. For example, the data circuit is completed (or forms a closed loop) once the consumable 104 is attached to the device 100. At the point of attachment, at least one circumferential data contact of the consumable 104 interfaces with the corresponding data contact of the device 100. Once interfaced, the data circuit may then be in electronic communication with the controller 120 and/or the memory 122 of the device 100. In this way, the data circuit enables information communication and/or exchange between the consumable 104 and the device 100. The information may take the form of electronic data signals powered by the power source 118 in the device 100.

In this way, the circumferential data contact 200 enables the consumable 104 to communicate information with the device 100, and by extension, communicate information with the user of that device 100. In an example embodiment, such information may include the "type" of e-liquid (e.g., flavor, nicotine content or strength, etc.) contained within tank 106 of the particular consumable 104 that may be attached (or mated) with the device 100. For example, the device 100 may comprise an e-liquid indicator (not shown in the figures). The e-liquid indicator may be in form of an acoustic indicator (e.g., a buzzer, speaker, etc.), a light indicator (e.g., an LED), and/or a user display (e.g., an LCD panel). The e-liquid indicator is able to notify the user of the "type" of e-liquid currently in the consumable. Such a notification may be a certain color light being generated by the light indicator, an acoustic signal indicating the flavor of the e-liquid (e.g., the speaker emits a voice recording saying "mint flavor"), of the name of the e-liquid flavor is displayed on the user display. As the skilled person will appreciate, other types of user notifications are possible, and the disclosure is not limited to the notifications given here by example.

Different consumables 104 owned by the user may contain different e-liquid types, however the consumables 104 may appear identical to each other on the exterior, particularly if the e-liquid is not clearly visible to the user (e.g., even when viewed through the window 112). The disclosure advantageously enables a "smart" functionality of the device 100, where the user is able to quickly determine the e-liquid type upon connection of the consumable 104 with the device 100, without having to inhale or taste the e-liquid to make such a determination, for example. This may be particularly beneficial to the user, as it is often not possible to distinguish between different consumables 104 by merely observing their outer appearances, for example. Furthermore this "smart" functionality provides the user with a more premium product feel.

Figure 5:
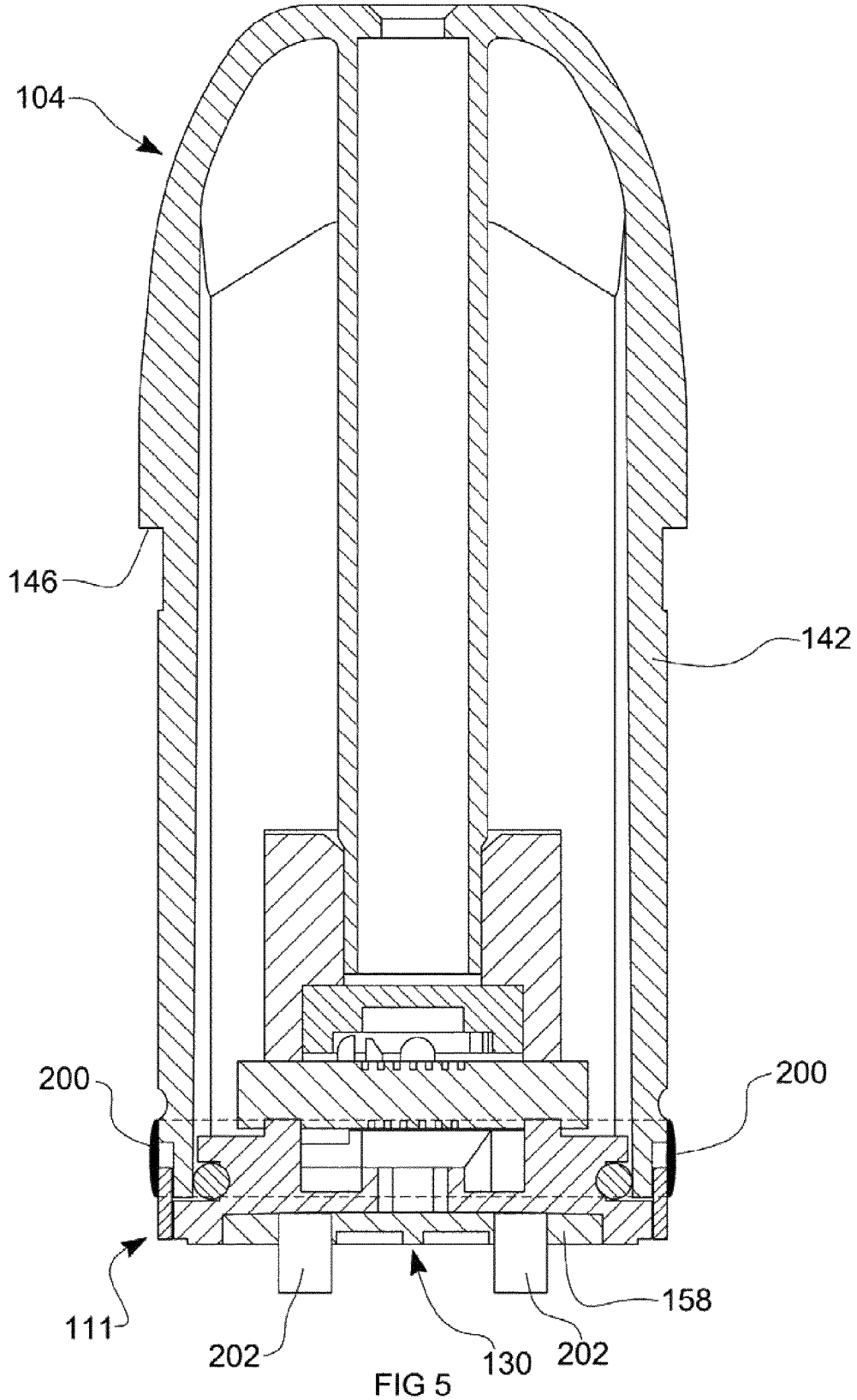
FIG. 5 is a section view of the consumable shown in FIG. 4.

FIG. 5 is a section view of the consumable shown in FIG. 4. Referring to FIG. 5, the circumferential data contact is shown as a full annular contact region 200 located on an outer circumferential surface of the consumable 104 near to contact end 111. In other words, rather than being a protruding contact (such as the electrical contacts 202, for example), the full annular contact region 200 is instead located all the way around the circumference of the consumable 104. In the embodiments shown in both FIG. 4 and FIG. 5, the full annular contact region 200 are in the form of a full ring 200 (also known as a full annulus). As the skilled person will appreciate, there may be more than one full annular contact regions 200 used by the consumable 104. The disclosure is not limited to the particular configurations shown in either FIG. 4 or FIG. 5, where the contact region 200 is located near to the contact end 111 of the consumable 104. In other embodiments (not shown in the figures), the full annular contact region 200 may alternatively, or additionally, be located anywhere along the tank housing 142, for example. Alternatively, or additionally, one or more full annular contact regions 200 may be located on the contact end 111 itself. For example, if there are multiple full annular contact regions 200 located on the contact end 111, they may be concentrically orientated.

Figure 6:
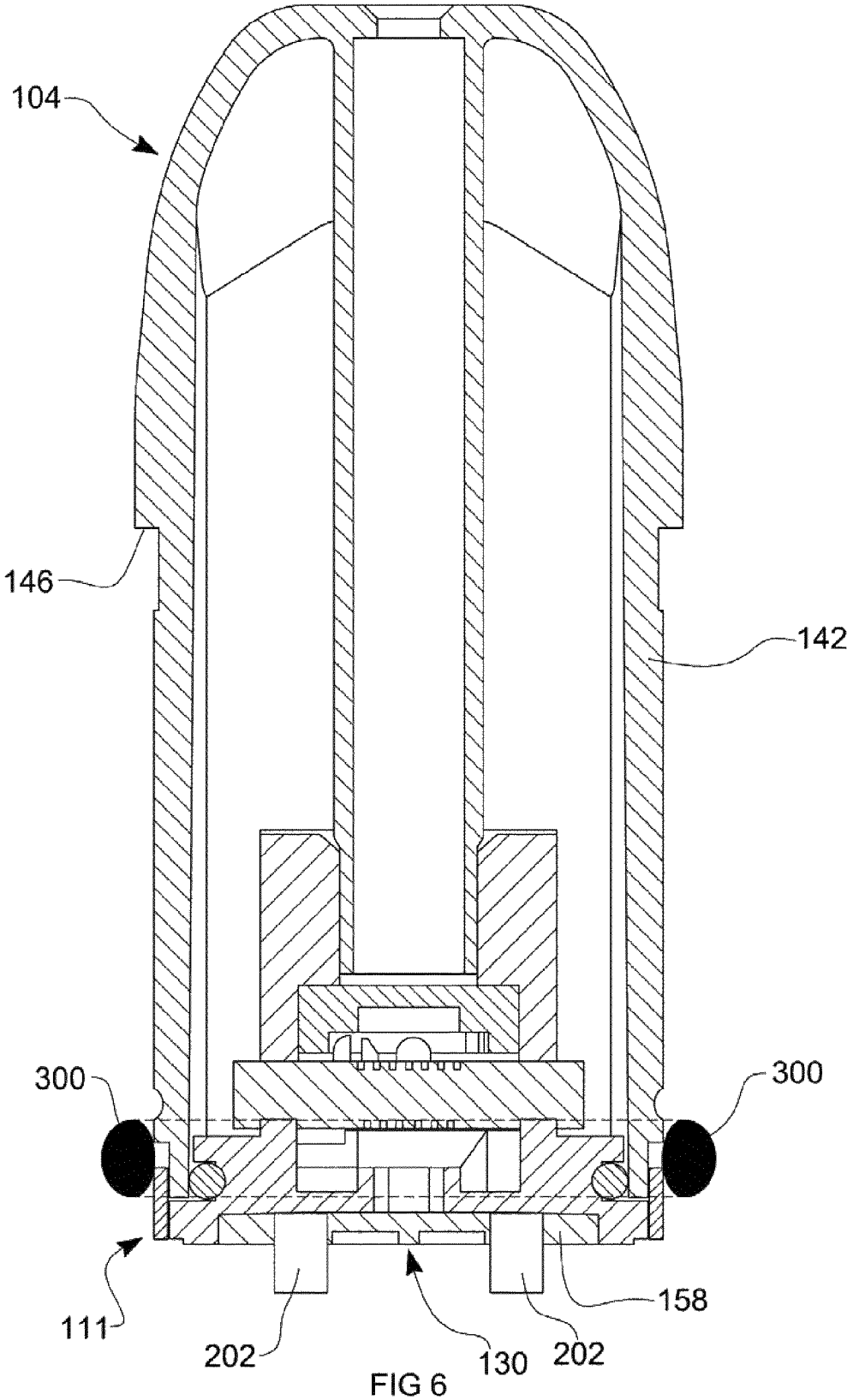
FIG. 6 is a section view of an alternative embodiment of the present disclosure.

FIG. 6 is a section view of the consumable 104 showing an alternative embodiment of a full annular contact region 300. The circumferential data contact is shown as a full annular contact region 300 located on an outer circumferential surface of the consumable 104 near to contact end 111. In this embodiment, the full annular contact region 300 is in the shape of a full torus 300 (also known as a "doughnut" shape). In this embodiment, the surface area of the full annular contact region 300 is be defined by the exposed outer surface area of the full torus 300 (i.e., the outer surface area that is not in contact with the consumable 104). As the skilled person will appreciate, there may be more than one full annular contact regions 300 used by the consumable 104. The disclosure is not limited to the particular configuration shown in FIG. 6, where the contact region 300 is located near to the contact end 111 of the consumable 104. In other embodiments (not shown in the figures) and the full annular contact region 300 may alternatively, or additionally, be located anywhere along the tank housing 142, for example. Alternatively, or additionally, one or more full annular contact regions 300 may be located on the contact end 111 itself. For example, if there are multiple full annular contact regions 300 located on the contact end 111, they may be concentrically orientated.

Referring to FIGS. 4 to 6, the full ring 200 and the full torus 300 both have an outer circumference and an inner circumference (not labelled in the figures), whereby the outer circumference may be greater than the inner circumference, and the inner circumference is at least equal to a circumference of the tank housing 142. In an example embodiment, the inner circumference forms an interference fit with the tank housing 142 in order to form an electrical connection with the data circuit (not shown) of the consumable 104. Alternatively, the inner circumference may be adhesively bonded to the tank housing 142 in order to form an electrical connection with the data circuit of the consumable 104.

As the skilled person will appreciate, the circumferential data contacts are not limited to the specific configurations shown in FIGS. 4 to 6. For example, the full ring 200 (as shown in FIGS. 4 and 5) and the full torus 300 (as shown in FIG. 6) may form a two-dimensional profile which is rotationally symmetrical about the longitudinal axis of the consumable 104. Preferably, the two-dimensional profile of the full ring 200 and the full torus 300 is either a circle, an oblate-circle, or an ellipse.

Circumferential data contacts advantageously allow the consumable 104 to be inserted in any direction that allows for the electrical contacts 202 to be engaged with corresponding electrical contacts of the device 100. As such, whenever the user wishes to connect the consumable 104 to the device 100, the user is not always required to orientate the consumable 104 in a particular way (e.g., by rotating the consumable 104 about the longitudinal axis of the consumable 104) in order to ensure a correct alignment of the contacts of the consumable 104 with corresponding contacts at the device end, as the device 100 is able to accept multiple orientations of the consumable 104. As such, the user's experience of the device 100 is improved as it may be less fiddly to use, and less time consuming to operate. Furthermore, the ability of the disclosure to freely orientate the consumable 104 in order to connect it with the device 100 provides the user with a more premium product feel (e.g., a "click-and-go" freedom).

As the device 100 is able to accept multiple orientations of the consumable 104, there may be a reduced need for user to always ensure that the orientation of the consumable 104 is correct. As such, there may be further advantages in that there is reduced risk of the user either wrongly orientating, or misaligning, the contacts of the consumable 104 with the corresponding contacts of the device 100. This may subsequently reduce the risk of both damage and failure of the corresponding contacts caused by user mistaking forcing incorrectly aligned, or misaligning, contacts together, for example. Moreover, the user's experience of the device 100 may be improved as they are provided with the "smart" pod functionality without compromising the "click-and-go" freedom. Furthermore, circumferential data contacts may intrinsically be more robust than protruding contacts (e.g., a plug, prong, pin, pad etc.) as they are typically less prone to being bent or broken when compared with protruding metal contacts. As such, by using a circumferential data contact (e.g., in place of a protruding contact), the instances of the data contacts of the device and/or the consumable breaking are advantageously reduced.

Figure 7:
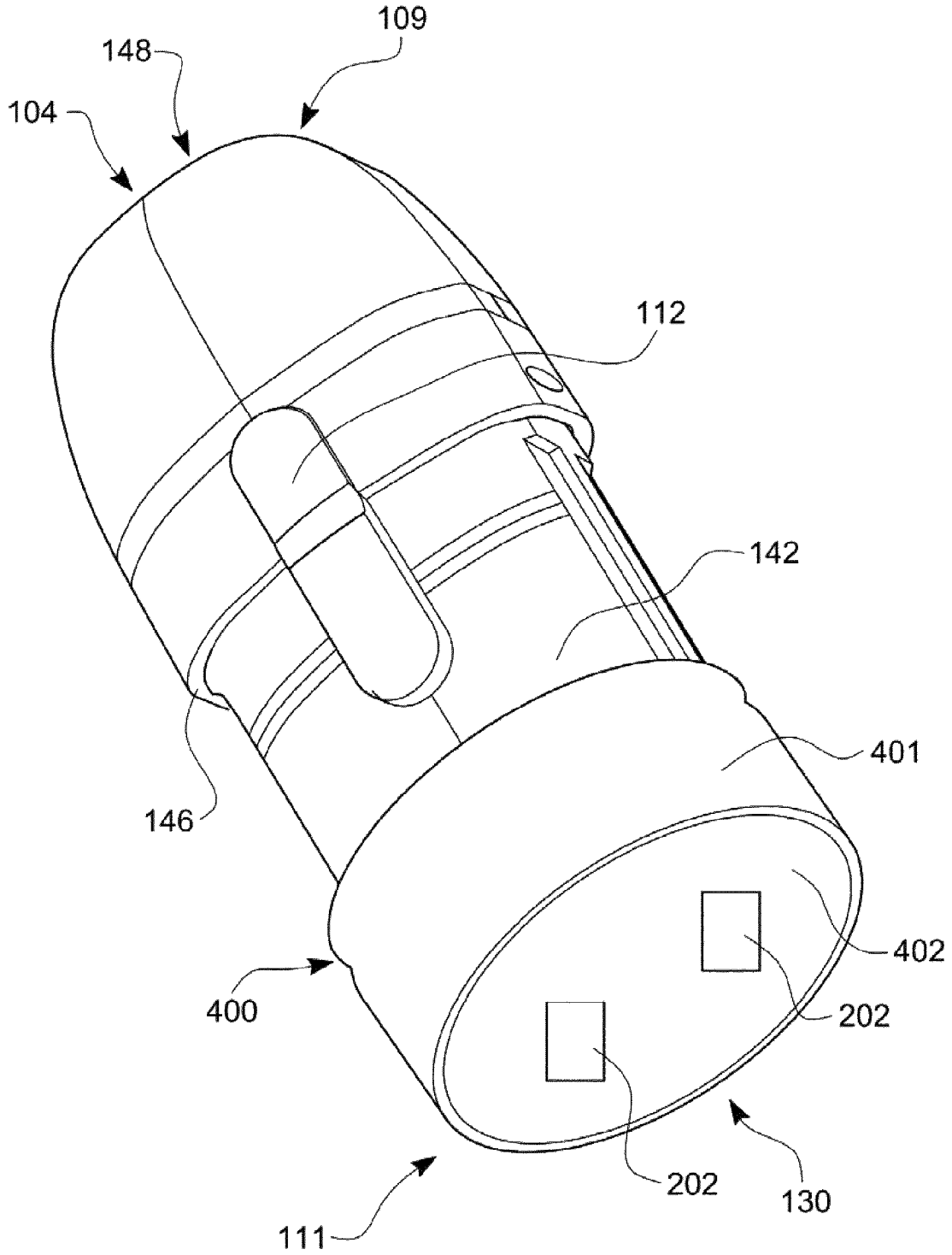
FIG. 7 is an isometric view of an alternative embodiment of the present disclosure.

FIG. 7 is an isometric view of the consumable 104 according to another embodiment of the present disclosure, where the circumferential data contact comprises a full cylindrical contact region 400. The full cylindrical contact region 400 may be a data contact region in the shape of a central cylindrical shell (or trunk) 401 with one end "closed off" by an end area 402 located at the bottom of the cylindrical shell 401. As such, the outer surface area of the full cylindrical contact region 400 may be defined by the combined outer surface areas of the cylindrical shell 401 and the end area 402. In the embodiment shown in FIG. 7, the end area 402 envelopes the contact end 111 of the consumable 104, and the cylindrical shell 401 envelopes a portion of the tank housing 142. In this way, the at least one end area 402 effectively "closes off" one side of the cylindrical shell 401. The end area 402 may have a diameter, radius, or circumference equal to that of the cylindrical shell 401. Alternatively, or in addition, the end area 402 may have a diameter, radius, or circumference equal to that of the tank housing 142. As the skilled person will appreciate, the full cylindrical contact region 400 is not limited to the specific configurations shown in FIG. 7. For example, the end area 402 may form a two-dimensional profile which is rotationally symmetrical about the longitudinal axis of the consumable 104. Preferably, the two-dimensional profile of the end area 402 is either a circle, an oblate-circle, or an ellipse.

Figure 8:
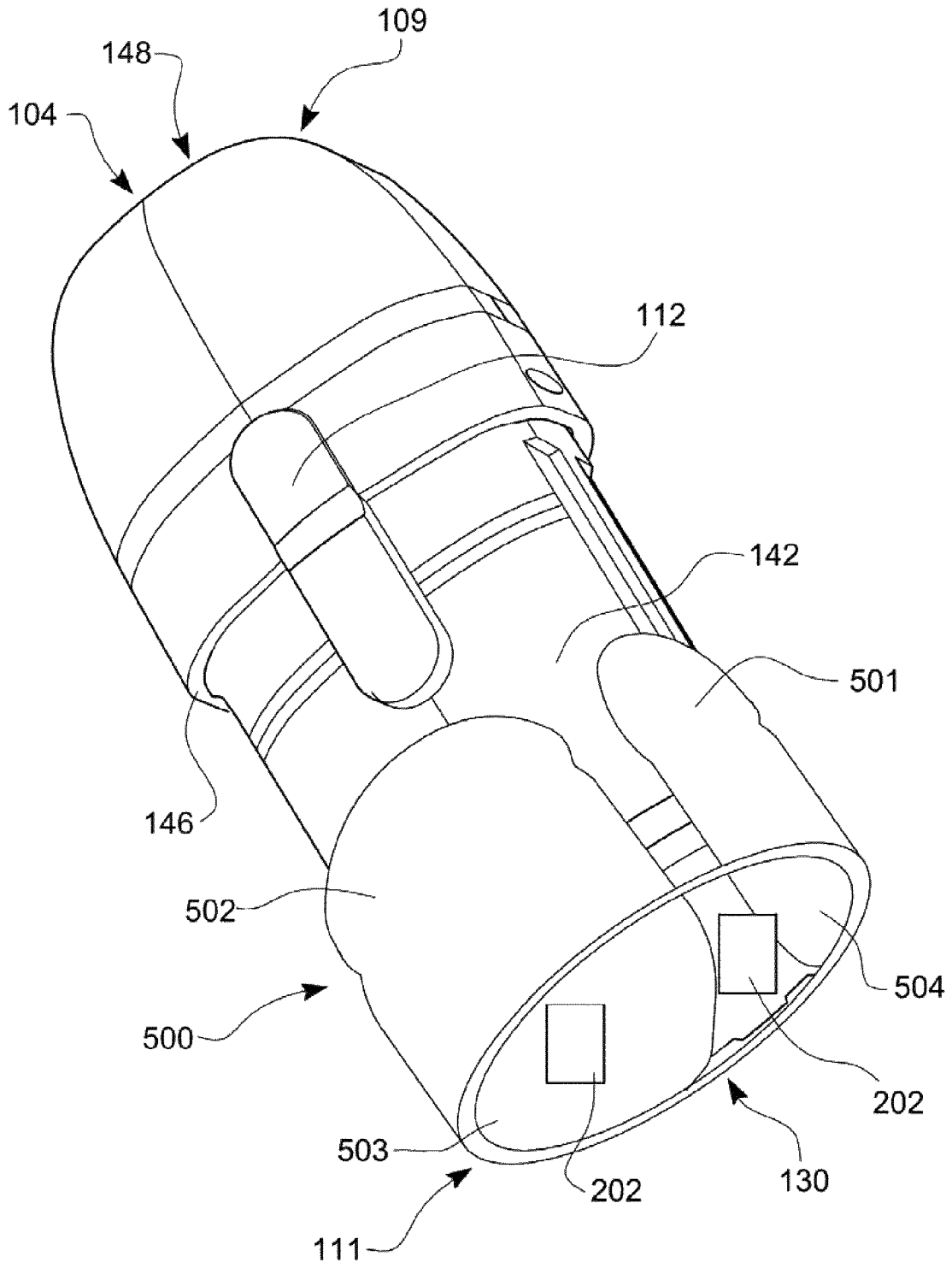
FIG. 8 is an isometric view of an alternative embodiment of the present disclosure.

FIG. 8 is an isometric view of the consumable 104 according to another embodiment of the present disclosure, where the at least one circumferential data contact comprises a partial cylindrical contact region 500 in the form of an incomplete (or partial) cylinder. The partial cylindrical contact region 500 has two components 501 and 502 that are only connected at one end and do not meet at the other end, such that they from an incomplete (or partial) cylinder. As such, the partial cylindrical contact region 500 is not fully formed along its circumferential axis. Alternatively, the partial cylindrical contact region 500 may not be fully formed along its radial axis (not shown in the figures). In the embodiment shown in FIG. 8, the component 501 partially envelopes the contact end 111 at an overlapping region 504, and the component 502 partially envelopes the contact end 111 at an overlapping region 503. In this way, the contact end 111 is partially "closed off" by both the overlapping regions 503 and 504.

Figure 9:
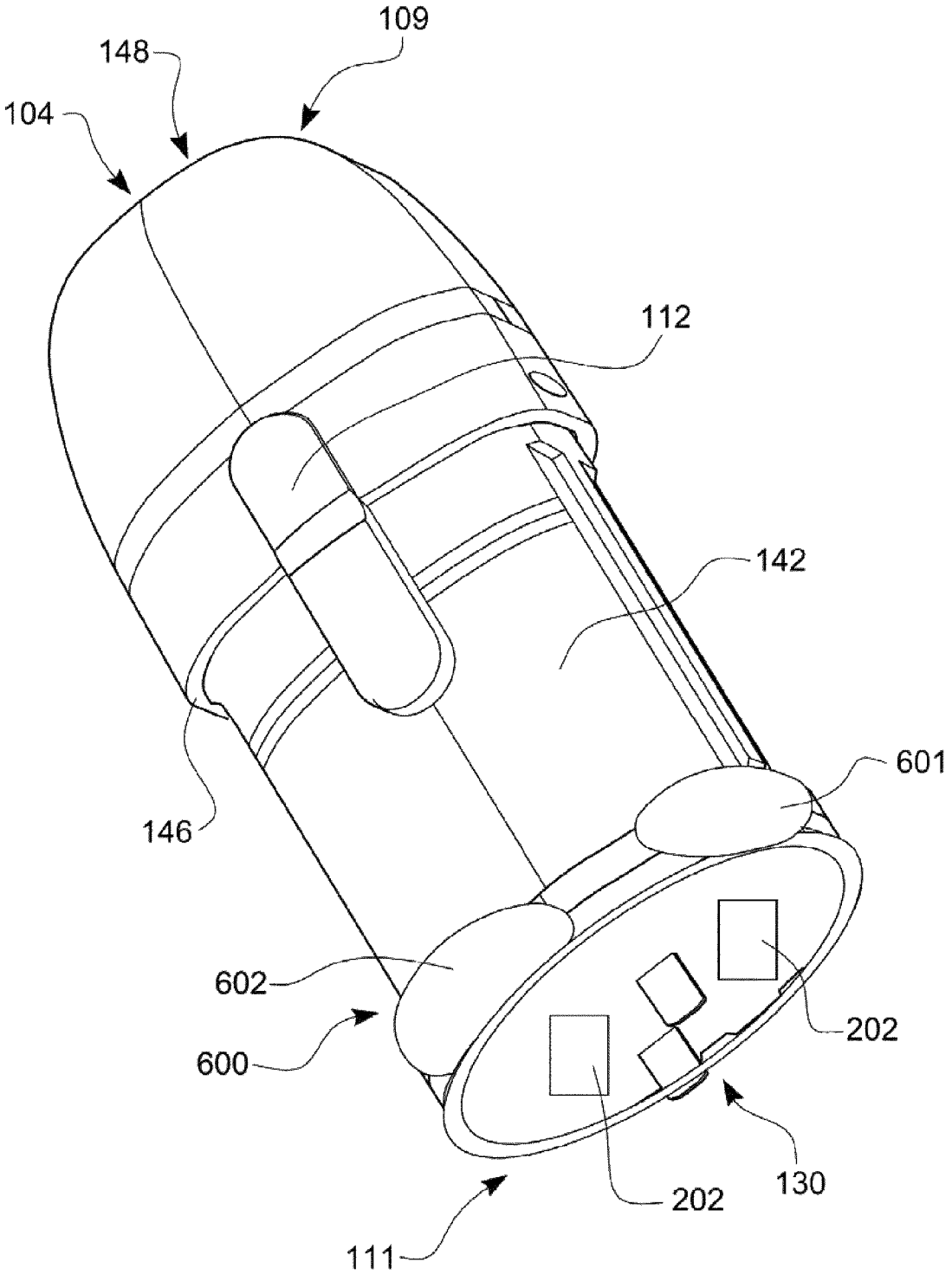
FIG. 9 is an isometric view of an alternative embodiment of the present disclosure.

FIG. 9 is an isometric view of the consumable 104 according to another embodiment of the present disclosure, where the at least one circumferential data contact comprises a partial annular contact region 600 in the form of an incomplete (or partial) torus. Analogous to the embodiment shown in FIG. 8, the partial annular contact region 600 has two components 601 and 602 that are only connected at one end and do not meet at the other end. As such, the partial annular contact region 600 is not fully formed along its toroidal axis. Alternatively, the partial annular contact region 600 may not be fully formed along its poloidal axis (not shown in the figures). As the skilled person will appreciate, there may be more than one partial annular contact region 600 used by the consumable 104. The disclosure is not limited to the particular configuration shown in FIG. 9, where the partial annular contact region 600 is located near to the contact end 111 of the consumable 104. In other embodiments (not shown in the figures) the partial annular contact region 600 may alternatively, or additionally, be located anywhere along the tank housing 142, for example. Alternatively, or additionally, one or more partial annular contact regions 600 may be located on the contact end 111 itself (e.g., concentrically located). For example, if there are multiple partial annular contact regions 600 located on the contact end 111, they may be concentrically orientated.

Figure 10:
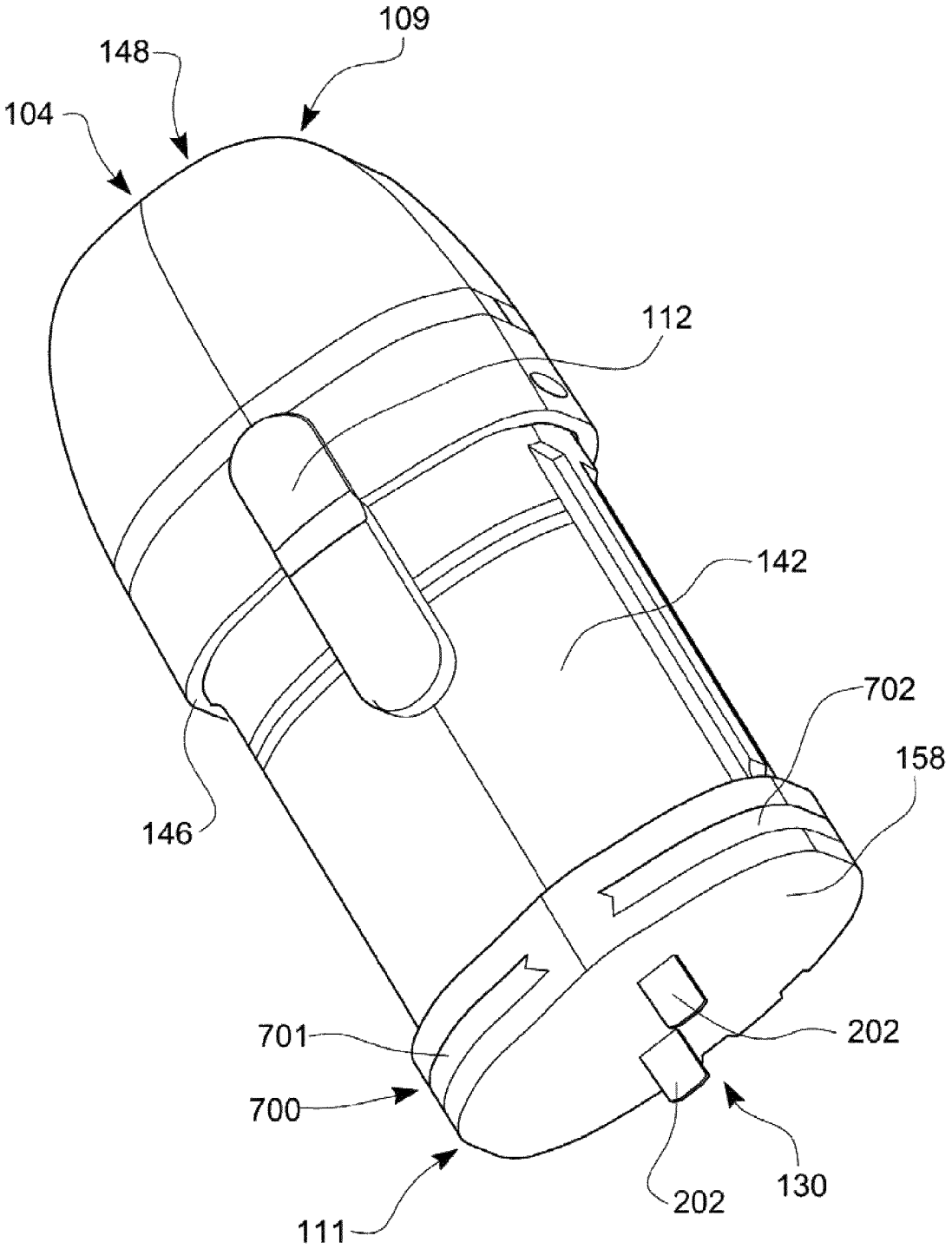
FIG. 10 is an isometric view of an alternative embodiment of the present disclosure.

FIG. 10 is an isometric view of the consumable 104 according to another embodiment of the present disclosure, where the at least one circumferential data contact comprises a partial annular region 700 in the form of an incomplete (or partial) ring. Analogous to the embodiments shown in FIG. 8 and FIG. 9, the partial annular contact region 700 has two components 701 and 702 that are only connected at one end and do not meet at the other end. In other words, the ring is not fully formed along its circumferential axis. Alternatively, the partial annular region 700 may not be fully formed along its radial axis (not shown in the figures). As the skilled person will appreciate, there may be more than one partial annular contact regions 700 used by the consumable 104. The disclosure is not limited to the particular configuration shown in FIG. 10, where the partial annular contact region 700 is located near to the contact end 111 of the consumable 104. In other embodiments (not shown in the figures) and the partial annular contact region 700 may alternatively, or additionally, be located anywhere along the tank housing 142, for example. Alternatively, or additionally, one or more partial annular contact regions 700 may be located on the contact end 111 itself. For example, if there are multiple partial annular contact regions 700 located on the contact end 111, they may be concentrically orientated.

Figure 11:
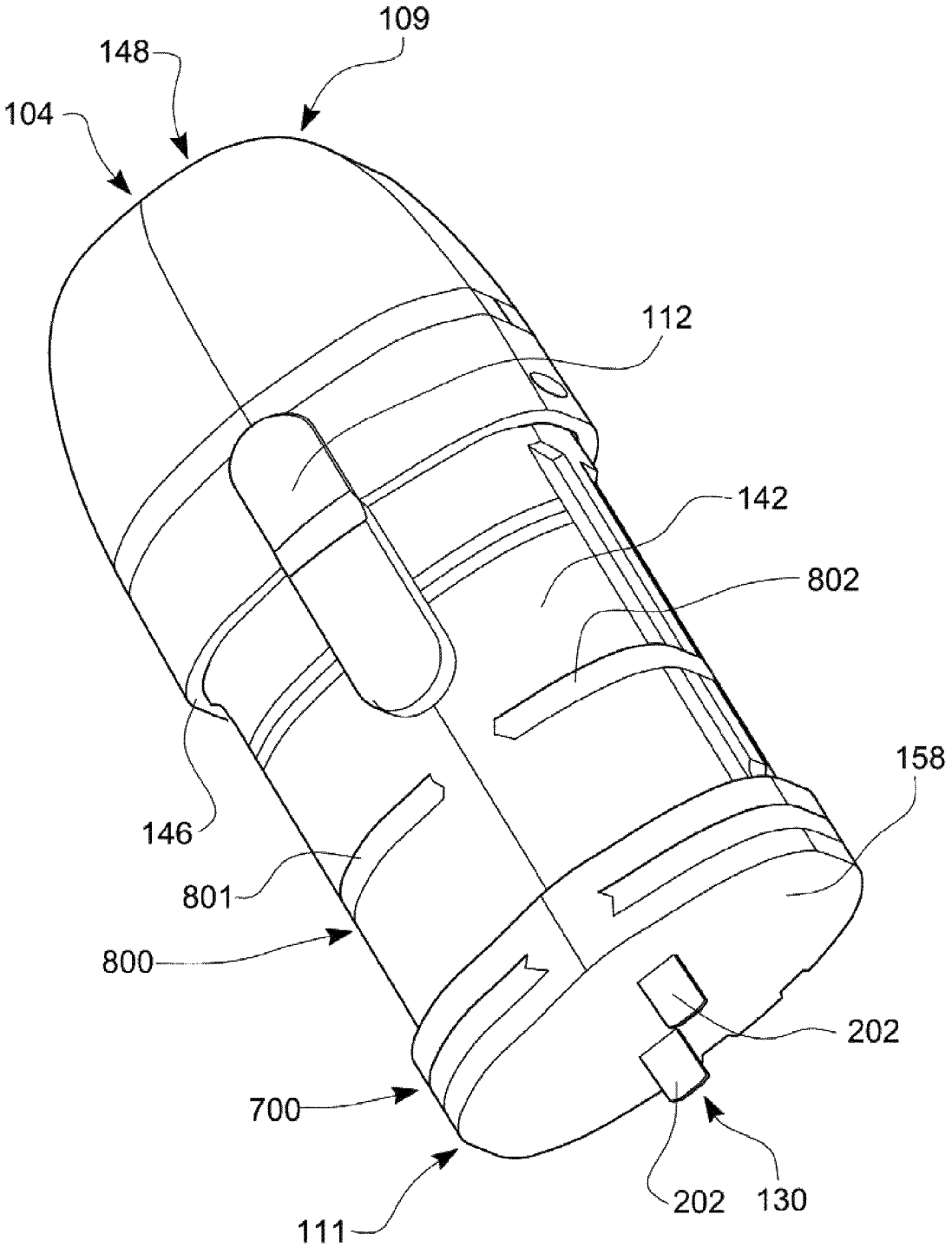
FIG. 11 is an isometric view of an alternative embodiment of the present disclosure.

FIG. 11 is an isometric view of the consumable 104 according to another embodiment of the present disclosure, where the circumferential data contact 800 may be located at a region of the outer circumferential surface of the consumable 104 and is spaced, or separated, from the contact end 111 along the longitudinal axis of the consumable 104.

By way of example, the embodiment shown in FIG. 11 shows one partial annular region in the form of an incomplete (or partial) ring 800 located on the tank housing 142. The partial ring 800 is spaced, or separated, from both the contact end 111 and from another partial ring 700 along the longitudinal axis of the consumable 104, and where the partial ring 700 is located near to the contact end 111. In this way, the partial ring 800 may be at a location on the consumable 104 that is separated, or spaced away from, the contact end 111 of the consumable 104. This spacing may be a formed by a gap or void (as shown in FIG. 11). Alternatively, or additionally, the spacing may be a formed by separating material (not shown in the figures). In an example embodiment, the separating material may be formed from an electrically insulating material. In a preferred embodiment, the separating material is the same material as the tank housing 142. As the skilled person will appreciate, there may be multiple (e.g., more than two) partial annular contact regions used by the consumable 104. The disclosure is not limited to the particular configuration shown in FIG. 11. In other embodiments (not shown in the figures) the partial annular contact regions 700, 800 may alternatively, or additionally, be located anywhere along the tank housing 142, for example. Alternatively, or additionally, one or more partial annular contact regions 700, 800 may both be located on the contact end 111 itself. For example, partial annular contact regions 700, 800 may be concentrically orientated on the contact end 111.

In an alternative embodiment of the consumable, the contact end 111 of the consumable 104 may include a recess (not shown in any of the figures). In a preferred embodiment, the recess extends along the longitudinal axis into the consumable 104, away from the contact end 111, and towards the inside of the upper end 109 of the consumable 104. In this way, the recess defines a cylindrical shell with an inner circumferential surface area. The inner circumferential surface area may therefore be defined by internal walls (not shown in the figures) of the tank housing 142 of the consumable 104.

In this preferred embodiment, at least one of the previously described circumferential data contacts may be either formed by, or located anywhere on, the inner circumferential surface area (not shown in the figures). In other words, the circumferential data contact may be formed by all, or part of, the inner circumferential surface area of the cylindrical shell. For example, the circumferential data contact may be full or partial internal cylinder (analogous to the embodiments shown in FIGS. 7 and 8, respectively).

Alternatively, the at least one circumferential data contact may be the following: a full ring (analogous to the embodiments shown FIGS. 4 and 5), a partial ring (analogous to the embodiments shown in FIGS. 10 and 11), a full torus (analogous to the embodiment shown in FIG. 6), and/or a partial torus (analogous to the embodiment show in FIG. 9) as previously described, but instead located anywhere on the inner circumferential surface area of the recess.

As the skilled person will further appreciate, the consumable 104 of the present application may use more than one type of circumferential data contacts of the previously described embodiments. As such, each embodiment of the consumable 104 is not limited to one particular type, or number of, circumferential data contact. For example, each embodiment of the consumable 104 may use one or more of the previously described circumferential data contact types in any combination with each other.

In a preferred embodiment, all of the circumferential data contacts of the previously described embodiments are electrical contacts (e.g., electrodes) that are in electrical connection with the data circuit of the consumable 104 at least. In this way, the circumferential data contacts are made from an electrically conductive material, preferably a metallic material.

Figure 12:
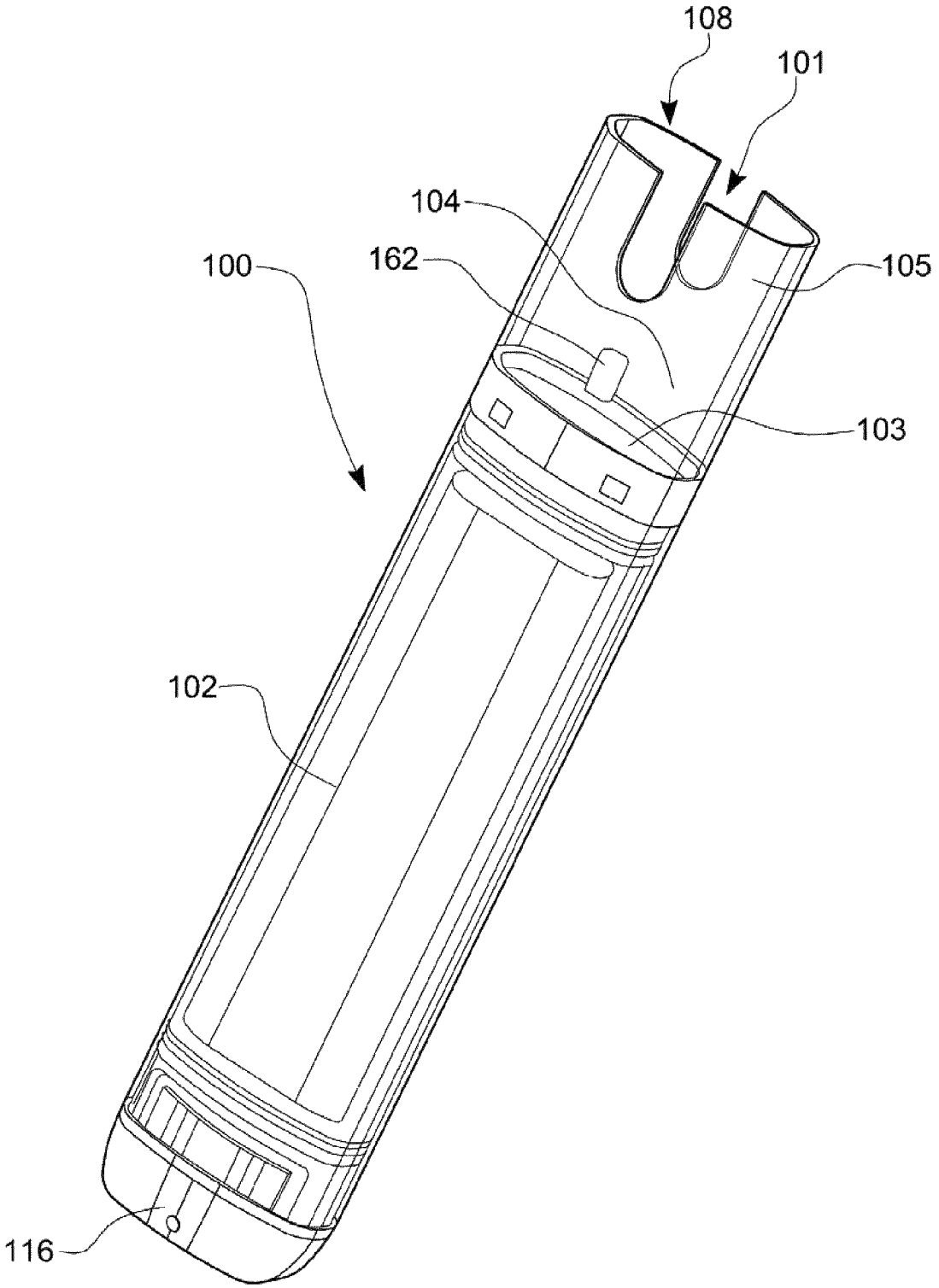
FIG. 12 is an isometric view of an alternative embodiment of the present disclosure.

FIG. 12 is an isometric view of the smoking substitute device 100 shown in FIGS. 1A and 1B according to an example embodiment of the present disclosure. Referring to FIG. 12, the device 100 may comprises a recess (or cavity) 101 configured to receive the contact end 111 of the consumable 104.

In the example embodiment shown in FIG. 12, the recess 101 comprises an opening at the upper end 108 of the device 100. The recess 101 defines a cylindrical shell 105 which has an inner circumference 104 that extends away from the upper end 108, and towards the main body 102, along a longitudinal axis of the device 100. In a preferred embodiment, the cylindrical shell 105 extends to a floor 103 to form a recess 101 of finite depth. In an alternative embodiment (not shown), the recess 101 may have no floor.

Referring to the embodiment shown FIG. 12, the cylindrical shell 105 is preferably elliptical in shape. However, as the skilled person will appreciate, the cylindrical shell 105 may be any other rotationally symmetrical shape (e.g., a circle, an oblate-circle, etc.) suitable for receiving the contact end 111 of the previous described embodiments of the consumable 104. A corresponding data contact 162 of the device 100 is formed by, or located anywhere on, the inner circumference 104 of the recess 101. In the example embodiment shown in FIG. 12, the corresponding data contact 162 of the device 100 is shown as an electrode (in the form of a contact "notch") located at one end of the inner circumference 104 of the recess 101. As the skilled person will appreciate, the corresponding data contact 162 may be any type of electronic connector or electrode, and may be at least one socket and/or pad contact (not shown in the figures). Alternatively, or additionally, the corresponding data contact 162 of the device 100 may be any one of the circumferential data contacts as of the previously described embodiments. As the skilled person will further appreciate, the corresponding data contact 162 is not limited to the configuration shown in FIG. 12. For example, alternatively or additionally, the corresponding data contact 162 may be located anywhere on the inner circumference 104 and/or the floor 103 of the recess 101.

In one embodiment, the at least one data contact may include a first data contact on a first side of the consumable 104 and a second data contact on a second side of the consumable 104, where the first side may be opposite the second side.

In another aspect of the disclosure, there is a smoking substitute kit comprising the previously described smoking substitute consumable 104 and the previously described smoking substitute device 100.

In an example embodiment, the main body 102 of the smoking device 100, and the consumable 104, may comprise a metallic outer shell. The outer shell (not labelled) may be manufactured from aluminum or stainless steel. Alternatively, the outers shell may comprise a treated metallic shell, such as painted or brushed aluminum. The tank 106 of the consumable 104 may be made from a polymer, preferably a translucent or transparent polymer so that the e-liquid contained in the tank 106 is visible (or at least partially visible) to the user when viewed through the window 112. In a preferred embodiment, the window 112 is formed by the tank 106. As the skilled person will appreciate, any other type of suitable material may be used to form the above-mentioned components of either the device 100 or the consumable 104.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments described above, many equivalent modifications and variations will be apparent to those skilled in the art when given this disclosure. Accordingly, the exemplary embodiments of the disclosure set forth above are considered to be illustrative and not limiting.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

What is claimed is:

1. A smoking substitute consumable insertable into a smoking substitute device in at least a first orientation and a second orientation, the smoking substitute consumable comprising:

an electrical contact configured to interface with a corresponding electrical contact of the smoking substitute device, the electrical contact located at a contact end of the smoking substitute consumable; and at least one data contact region configured to interface with at least one corresponding data contact region of the smoking substitute device for data exchange, when the smoking substitute consumable is inserted into the smoking substitute device in either the first orientation or the second orientation, characterized in that the contact end of the smoking substitute consumable includes a recess defining an inner circumferential surface and wherein the at least one data contact region is either formed by, or located on, the inner circumferential surface.

2. The smoking substitute consumable of claim 1, wherein:

the smoking substitute consumable is insertable into the smoking substitute device in an insertion direction, the cross-section of the smoking substitute consumable viewed in a direction perpendicular to the insertion direction has two or more degrees of rotational symmetry; and the smoking substitute consumable includes a plurality of data contact regions, including at least one data contact region per degree of rotational symmetry.

3. The smoking substitute consumable of claim 1, wherein:

the plurality of data contact regions includes a first data contact and a second data contact, the first data contact and the second data contact being circumferentially spaced from each other.

4. The smoking substitute consumable of claim 3, wherein:

each of the plurality of data contact regions is a data contact, wherein all of the data contacts are circumferentially spaced from each other.

5. The smoking substitute consumable of claim 3, wherein:

the cross-section of the smoking substitute consumable viewed in a direction perpendicular to the insertion direction has an even number of degrees of rotational symmetry or is circular;

the first data contact is on a first side of the smoking substitute consumable;

the second data contact is on a second side of the smoking substitute consumable; and the first side is opposite the second side.

6. The smoking substitute consumable of claim 1, wherein:

the at least one data contact region or plurality of data contact regions all form part of a single data contact.

7. The smoking substitute consumable of claim 6, wherein:

the single data contact is a circumferential data contact.

8. The smoking substitute consumable of claim 1; wherein the at least one data contact region is formed by, or located on, an end surface of the consumable.

9. A smoking substitute device for use with a smoking substitute consumable according to claim 1.

10. The smoking substitute device according to claim 9; wherein the device comprises a recess configured to receive the contact end of the smoking substitute consumable.

11. The smoking substitute device according to claim 9; wherein the corresponding data contact region of the device is formed by, or located anywhere on, the inner circumference of the recess.

12. The smoking substitute device according to claim 9; wherein the corresponding electrical contact region of the device is located anywhere on the floor of the recess and comprises at least one socket and/or pad contact.

13. A smoking substitute kit comprising the smoking substitute consumable according to claim 1 and the smoking substitute device according to claim 9.

* * * * *